US008955352B2

(12) United States Patent
Lee et al.

(10) Patent No.: US 8,955,352 B2
(45) Date of Patent: Feb. 17, 2015

(54) REFRIGERATOR

(75) Inventors: Su Won Lee, Gyeongsangnam-do (KR); Hyeung Ju Kim, Gyeongsangnam-do (KR); Kyung Eun Lee, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 267 days.

(21) Appl. No.: 13/319,546

(22) PCT Filed: Sep. 3, 2009

(86) PCT No.: PCT/KR2009/004965

§ 371 (c)(1),
(2), (4) Date: Nov. 9, 2011

(87) PCT Pub. No.: WO2010/131811

PCT Pub. Date: Nov. 18, 2010

(65) Prior Publication Data

US 2012/0060544 A1 Mar. 15, 2012

(30) Foreign Application Priority Data

May 12, 2009 (KR) ..... 10-2009-0041166

(51) Int. Cl.
*F25D 25/02* (2006.01)
*F25D 23/02* (2006.01)

(52) U.S. Cl.
CPC ..... *F25D 25/025* (2013.01); *F25D 23/02* (2013.01); *F25D 23/025* (2013.01); *F25D 2331/803* (2013.01)
USPC ..... 62/441; 62/382; 62/449; 312/402; 312/404; 312/273; 312/327

(58) Field of Classification Search
USPC ..... 62/382, 449, 250, 457.4, 440, 441; 312/402, 404, 273, 274, 327
See application file for complete search history.

(56) References Cited

U.S. PATENT DOCUMENTS

| | | | | |
|---|---|---|---|---|
| 1,865,212 | A * | 6/1932 | Rogers et al. | 126/340 |
| 7,017,956 | B2 * | 3/2006 | Kogami | 292/224 |
| 2003/0136271 | A1 * | 7/2003 | Kim | 99/467 |
| 2005/0072178 | A1 * | 4/2005 | Park et al. | 62/389 |
| 2006/0016211 | A1 * | 1/2006 | Lyvers et al. | 62/440 |
| 2006/0049731 | A1 * | 3/2006 | Choi et al. | 312/330.1 |
| 2006/0226751 | A1 | 10/2006 | Park | |
| 2008/0168794 | A1 * | 7/2008 | Cho et al. | 62/441 |
| 2009/0193836 | A1 * | 8/2009 | Ertz et al. | 62/449 |
| 2010/0139307 | A1 * | 6/2010 | Kulkarni et al. | 62/407 |

FOREIGN PATENT DOCUMENTS

| | | | |
|---|---|---|---|
| JP | 2002-081852 | A | 3/2002 |
| KR | 20-1999-0018259 | U | 6/1999 |
| KR | 10-2001-0108667 | A | 12/2001 |
| KR | 10-2004-0085426 | A | 10/2004 |
| KR | 10-2006-0062149 | A | 6/2006 |
| KR | 10-2006-0106338 | A | 10/2006 |

OTHER PUBLICATIONS

PCT International Search Report dated Apr. 19, 2010 for Application No. PCT/KR2009/004965, with English Translation, 4 pages.

* cited by examiner

*Primary Examiner* — Judy Swann
*Assistant Examiner* — Zachary R Anderegg
(74) *Attorney, Agent, or Firm* — Fish & Richardson P.C.

(57) ABSTRACT

The present invention relates to a refrigerator. The present invention improves a structure of a door and a storage basket, thereby making it possible to facilitate the storage and a drawing out of articles.

10 Claims, 6 Drawing Sheets

REFRIGERATOR

CROSS REFERENCES RELATED APPLICATIONS

The present application claims the benefits of priority to Korean Patent Application No. 10-2009-0041166 filed on, 12 May 2009), which is hereby incorporated by reference in its entirety.

BACKGROUND OF THE INVENTION

1. Field of the Invention

The embodiment relates to a refrigerator.

2. Description of the Related Art

Generally, a refrigerator is home appliance that stores foods in a refrigerating or freezing state. The refrigerator is home appliance that drives a freezing cycle by electronic parts included therein and cools a storage space therein by directly/indirectly using a cool air generated by the freezing cycle.

Current technology trends are being focused on a large-sized, multi-functional, and use convenient refrigerator. In particular, many efforts to improve a structure of the refrigerator have been focused in order to maximize the storage capacity as compared to the same size.

The number and sorts of received items increase as the size of the refrigerator is getting larger. However, as the number of stored items increases, a case where a user easily forgets what items are stored in what storage chamber would occur. For example, when a plurality of refrigerating chambers are provided and when the same items are dispersed and stored in different refrigerating chambers, the user does not find the stored items such that the stored items are left in the refrigerating chamber for a long time, thereby damaging the contents.

Meanwhile, the size of the refrigerator door becomes large due to a large-sized refrigerator, such that there occurs a problem in that it is difficult for children, housewives, and old people to easily open the refrigerator door.

SUMMARY OF THE INVENTION

The present invention proposes to improve the above problems. The present invention provides a refrigerator having a storage chamber structure that enables users to easily approach stored contents. In other words, even though the number of stored contents is increased as the refrigerator is getting larger, an object of the present invention provides a refrigerator that enables users to easily grasp a storage position of desired contents.

In particular, another object of the present invention provides a refrigerator having a structure that enables children, which are lacking in judgment, to easily find items such as milk or carbonated drinks.

In addition, yet another object of the present invention provides a refrigerator having a door structure that can improve approach of children or old people even though the refrigerator is getting larger.

In order to achieve the above objects, there is provided a refrigerator according to an embodiment of the present invention, including: a storage chamber that keeps a low-temperature state; a main container that is provided to be able to be drawn out from the storage chamber and has a hole for drawing out on the front surface thereof; a door that is tiltably connected to the front of the main container in order to selectively open and close the storage chamber; and an auxiliary container that is seated inside the main container and drawn out through the hole in a state where the door is tilted.

There is a provided a refrigerator according to another embodiment of the present invention, including: a main body that has a storage chamber kept in a low-temperature state; a door that selectively opens and closes the storage chamber and is rotatably connected to the front surface of the main body; and a container that is received within the storage chamber and is drawn out from the storage chamber in a state where the door is tilted.

There is provided a refrigerator according to yet another embodiment of the present invention, including: a first storage chamber that is provided to store food in a refrigerating state; a second storage chamber that is provided to store food in a freezing state; a third storage chamber that is located between the first storage chamber and the second storage chamber and provided to store food in a refrigerating or freezing state; a container that is received in the third storage chamber; and a door that is tiltably connected to a front surface of the container or a front surface of the third storage chamber.

With the refrigerator structure according to the embodiment of the present invention forming the above configuration, it can store specific articles or vessels in a specific storage chamber at a time, such that it the users can easily draw out the vessels as well as do not confuse the storage positions of the specific articles or vessels, thereby increasing the use convenience.

In addition, articles stored inside the storage chamber can be drawn out only by the tilting operation of the storage door, thereby improving the operation convenience.

Moreover, any one of the tilting operation of the door or the sliding drawing out operation of the door can be selected according to the storage positions of articles, the articles can be easily drawn out even when the articles are deeply stored in the storage chamber.

In particular, children, which are relatively lacking in judgment, can easily draw out and receive articles, such that the use convenience increases.

DETAILED DESCRIPTION OF THE PREFERRED EMBODIMENTS

Hereinafter, embodiments of the present invention will be described in detail with reference to the accompanying drawings. The spirit of the present invention is not limited to the following embodiments and the accompanying drawings.

However, it is noted that the present invention is limited only by the appended claims corresponding to the right scope of the present invention.

Figure 1:
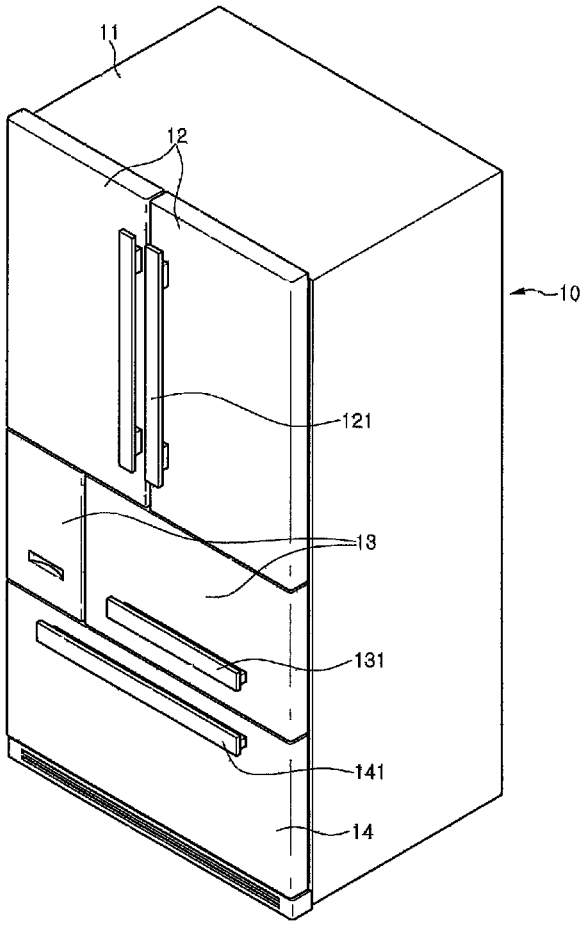
FIG. 1 is an exterior perspective view of a refrigerator according to an embodiment of the present invention.

FIG. 1 is an exterior perspective view of a refrigerator according to an embodiment of the present invention.

Referring to FIG. 1, a refrigerator 10 according to an embodiment of the present invention includes a main body 11 having a storage space provided therein, a door for selectively opening and closing the storage space, and a freezing cycle.

In detail, the freezing cycle includes a compressor, a condenser, an expander, and an evaporator. A portion of the freezing cycle is received in a machine room included in the main body 11.

It is noted that the embodiment describes, by way of example, a case where a refrigerating chamber door is five but is not limited thereto.

In more detail, in the embodiment, the door may include an upper door 12 that opens and closes the storage chamber provided at a relatively upper side of the main body 11, a middle door 13 that opens and closes the storage chamber provided at a lower side of the storage chamber opened and closed by the upper door 12, and a lower door 14 that opens and closes the storage chamber provided at a lower side of the storage chamber opened and closed by the middle door 13. Each door may be provided with handles 121, 131, and 141.

Figure 2:
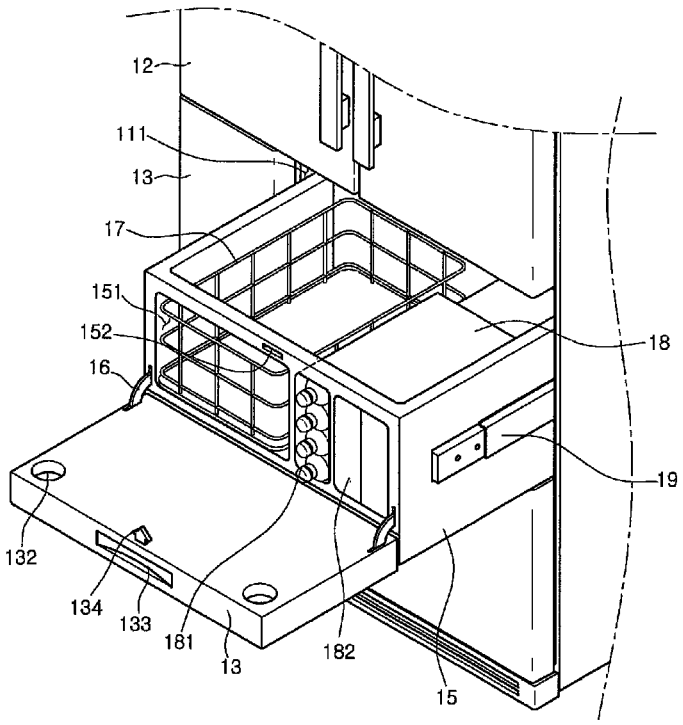
FIG. 2 is a perspective view showing a state where any one of storage chambers of the refrigerator according to the embodiment of the present invention is opened.
Figure 3:
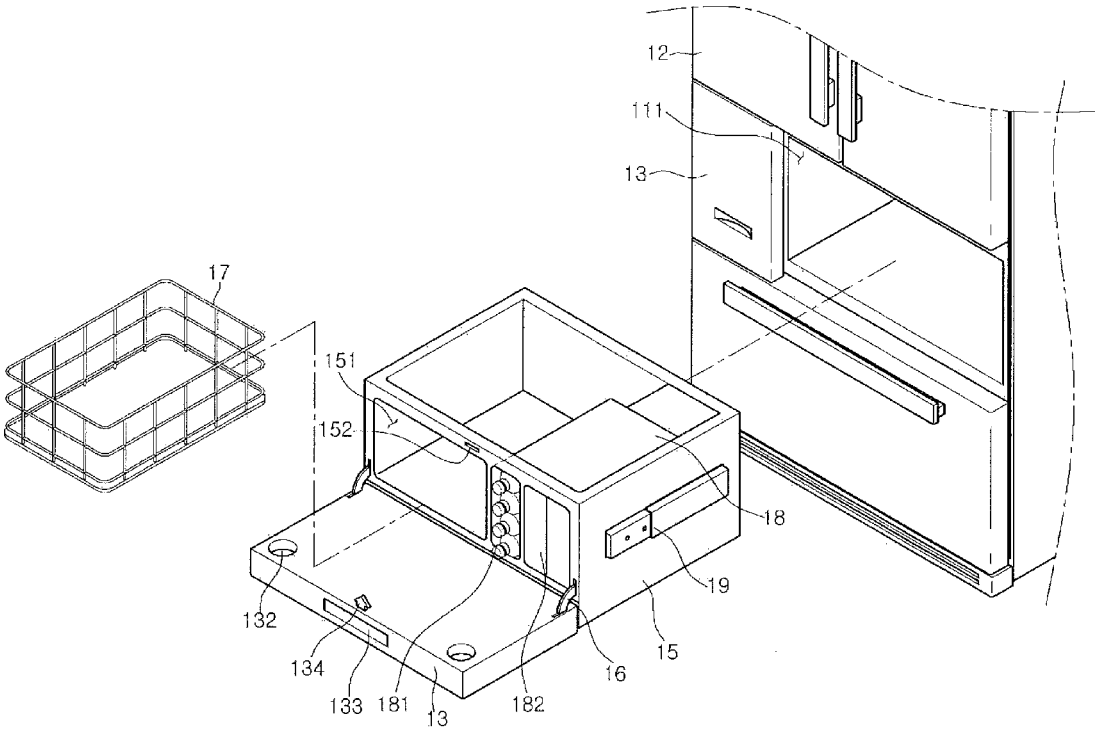
FIG. 3 is an exploded perspective view of configurations of FIG. 2, respectively.

FIG. 2 is a perspective view showing a state where any one of the storage chambers of the refrigerator according to the embodiment of the present invention is opened and FIG. 3 is an exploded perspective view showing configurations of FIG. 2, respectively.

Referring to FIGS. 2 and 3, the present embodiment describes, by way of example, a storage chamber 111 that is selectively opened and closed by the middle door 13.

In detail, the rear surface of the middle door 13 is connected with a main container 15 that receives foods or containers, wherein the main container 15 is received in the storage chamber 111 that is defined in the main body 11. The one side of the inside of the main container 15 may be provided with an auxiliary container 17 for receiving foods or beverage containers. The inside spacer of the main container 15 except for the space in which the auxiliary container 17 is received may be provided with a separate auxiliary cooling chamber 18. The auxiliary cooling chamber may be provided with a bottle chamber 181 in which beverage bottles are loaded and stored and a quick cooling chamber 182 for quickly cooling beverages.

In addition, the middle door 13 is tiltably connected to the front surface of the main container 15 and tiltably connected from a vertical state to a horizontal state by a hinge 16. The upper surface of the middle door 13 may be depressedly formed with a gripping groove 133 at a predetermined depth. Herein, the bottom surface of the middle door 13 may be formed with the gripping recess like the gripping groove 133 instead a handle 131 of the middle door 13. As a result, the front portion of the middle door forms a smooth plane, such that the exterior of the refrigerator 10 can be processed more sharply.

Moreover, the front surface of the main container 15 is formed with a front hole 151 for drawing out the auxiliary container 17. The front surface of the main container 15 corresponding to the front surface of the auxiliary cooling chamber 18 is formed with a hole that receives beverage bottles into the bottle chamber 181 and a door that opens and closes the quick cooling chamber 182.

Meanwhile, both side portions of the main container 15 is provided with rails 19 and the inside surface of the storage chamber 111 is provided with a rail guide (not shown) that guides the front and rear direction movements of the rail 19.

With the refrigerator having the above-mentioned configuration, the middle door 13 can be horizontally tilted to draw out the auxiliary container 17 in the state where the main container 15 is completely drawn in the inside of the storage chamber 111. In addition, the main container 15 is drawn out by pulling the middle door 13 in a vertical state, such that the auxiliary container 17 can be drawn out. In this case, the auxiliary container 17 can be drawn out by a lifting operating through the upper opening portion of the main container 15. The operation method will be described in more detail below with reference to the accompanying drawings.

Meanwhile, the rear surface of the middle door 13 is formed with a latch 134 and the front surface of the main container 15 may be formed with a latch hole 152 in which the latch 134 is inserted. Therefore, when the user grips the gripping groove 133 formed on the upper surface of the middle door 13 and then pulls it forward, the latch 134 is out of the latch hole 152, such that the middle door 13 can be tilted in a horizontal state. The latch 134 is operated as a general hanging means but may be used as a one-touch button manner. For example, by a pressing and releasing action onto the front surface of the middle door 13 in the state where the middle door 13 is closely attached to the front surface of the main container 15, the latch 134 may be out of the latch hole 152. The rotational shaft portion of the middle door 13 is inserted with an elastic member such as a torsion spring and a hydraulic damper structure, such that the middle door 13 can be automatically rotated to a horizontal state. This structure is frequently applied to a home bar structure for a refrigerator in the related art and therefore, the detailed configuration thereof will be omitted. However, it is noted that the spirit of the present invention can apply the above-mentioned one-touch button and the automatic rotating function.

Figure 4:
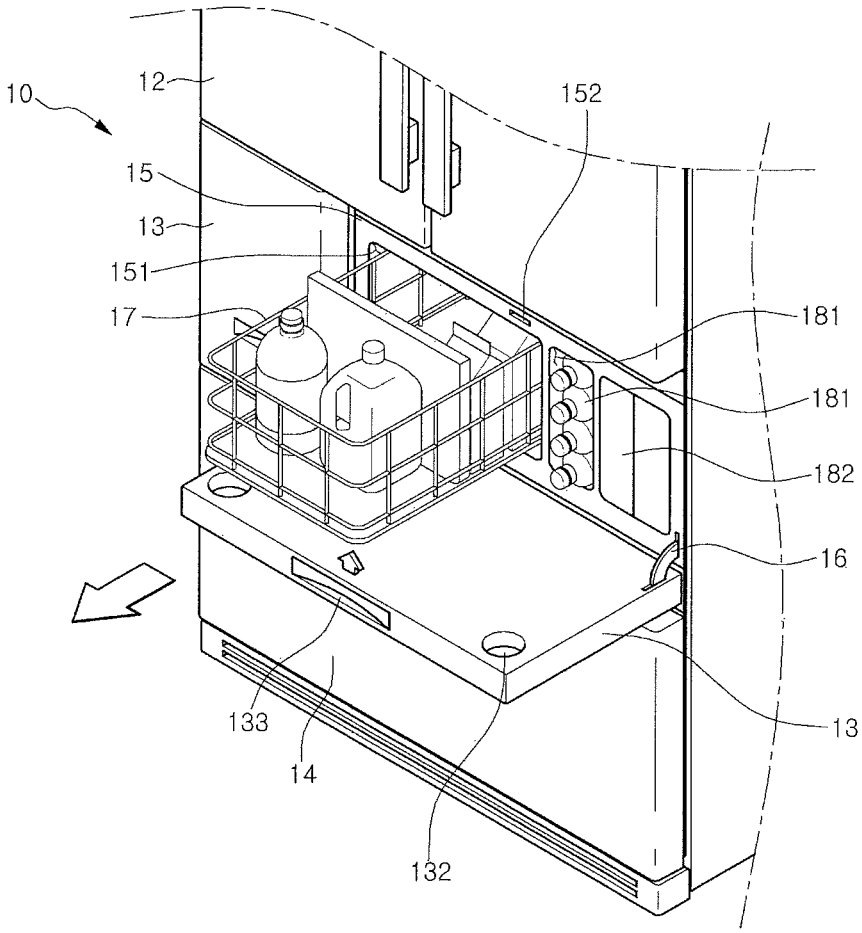
FIG. 4 is a perspective view showing a shape where a receiving rack of the refrigerator according to the embodiment of the present invention is drawn out.

FIG. 4 is a perspective view showing a shape where a receiving rack of the refrigerator according to the embodiment of the present invention is drawn out.

Referring to FIG. 4, a receiving rack of the refrigerator can be drawn out from the main container 15 by the operation that rotates the middle door 13 in a horizontal state and then draws out the auxiliary container 17 forward. The foods and the beverage container received in the auxiliary container 17 can be taken out.

In detail, the middle door 13 is tilted forward by the operation that inserts fingers in the gripping groove 133 formed on the upper surface of the middle door 13 and pulls it, or by the pressing and releasing action onto the front surface of the middle door 13 as described above. Then, the middle door 13 becomes a horizontal state and in this state, the auxiliary container 17 can be drawing out through the front hole 151 of the main container 15. When the middle door 13 is tilted in a horizontal state, the bottle chamber 181 is exposed, such that the beverage bottles received in the bottle chamber 181 can be easily taken out. In addition, when the middle door 13 rotates horizontally, the front portion of the quick freezing chamber 182 is exposed, such that the user can quickly cool beverage bottles by putting the beverage bottles in the quick cooling chamber 182.

Further, the rear surface of the middle door 13, that is, the surface corresponding to the upper surface when the middle door 13 is in the horizontal state, is formed with a cup supporting groove 132 on which a cup is placed. Therefore, after the user places a cup on the cup supporting groove 132, he/she can pour and drink beverages in the cup. In other words, the middle door 13 also performs the home bar function.

Figure 5:
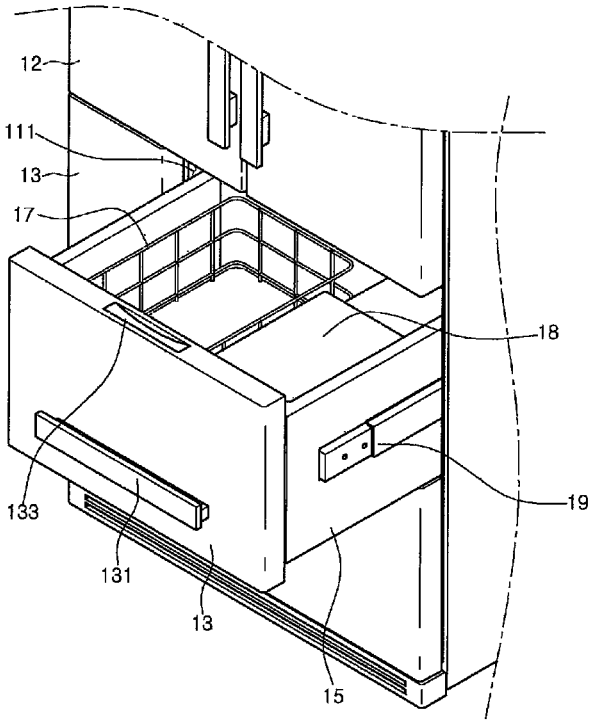
FIG. 5 is a perspective view showing a shape where a basket of the refrigerator according to the embodiment of the present invention is drawn out.

FIG. 5 is a perspective view showing a shape where a basket of the refrigerator according to the embodiment of the present invention is drawn out.

Referring to FIG. 5, when the user pulls the handle 131 formed on the front surface of the middle door 13, the middle door 13 is drawn out forward in a vertical state. Herein, the handle 131 is formed at a position close to the lower end of the middle door 13, such that the middle door 13 cannot be tilted by a force pulling the handle 131. Alternatively, the bottom surface portion of the middle door 13 is formed with a groove such as the gripping groove 133, such that the middle door 13 cannot be rotated during a process of drawing out the middle door.

In detail, when articles to be drawn out by the user exist the rear end area of the auxiliary container 17, it may be more convenient that the user draws out the main container forward rather than tilting the middle door 13. In this case, the user can operate the middle door 13 so that the middle door 13 and the main container 15 are drawn out forward together.

Meanwhile, when the containers, in which beverages are received, are stored in the storage chamber 111 at a time, it is easy to draw out the containers as well as since the storage positions of the beverage container are not confused, such that the use convenience is increased.

Figure 6:
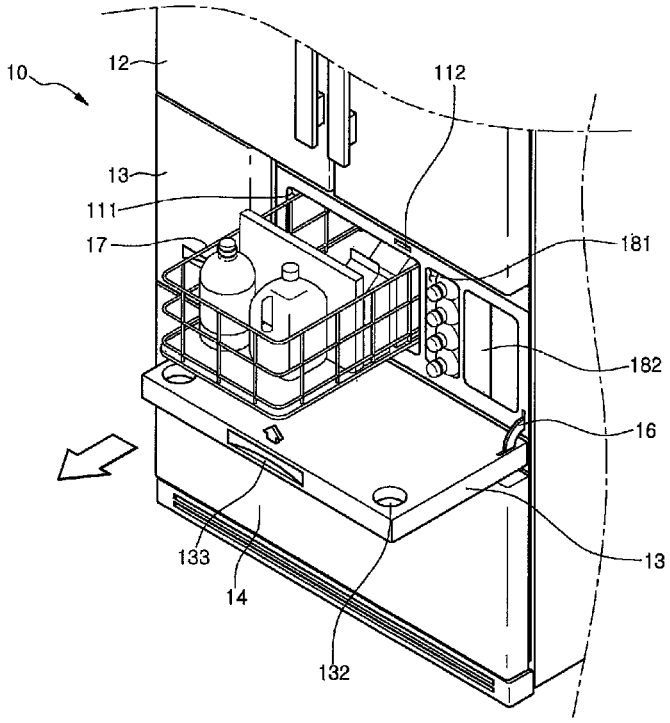
FIG. 6 is a partial perspective view of a refrigerator according to another embodiment of the present invention.

FIG. 6 is a partial perspective view of a refrigerator according to another embodiment of the present invention.

Referring to FIG. 6, the embodiment is characterized in that the main container 15 is removed from the above embodiment and the middle door 13 is rotatably provided to the front surface of the main body 11 by the hinge 16.

In detail, the auxiliary container 17 is received in the storage chamber 111 formed in the main body 11 and the storage chamber 111 is selectively shielded by the middle door 13. The bottle chamber 181 and the quick cooling chamber 182 may be provided in the storage chamber 111. Therefore, the bottle chamber 181 and the quick cooling chamber 182 are not drawn out forward and may be fixed in the storage chamber 111.

Further, the rear surface of the middle door 13 may be formed with the latch 134 and the front surface of the main body 11 may be formed with the latch hole 112. The structure of the latch 134 and the latch hole 112 can perform the same configuration and function as one described in the above embodiment and the rotational shaft of the middle door 13 may be provided with the elastic member or the hydraulic damper.

With the structure, when the foods and containers are stored in the deep spots of the storage chamber 111, the disadvantages in that it is difficult for the user to find the foods and containers and take out them can be improved. In other words, the auxiliary container 17 can be drawn out such that the foods or the containers stored in the auxiliary container 17 can be confirmed from the outside of the main body 11. Therefore, it can be immediately confirmed which spots the stored foods or the containers are positioned.

What is claimed is:

1. A refrigerator, comprising:

a main body having a storage chamber therein;

a main container that is provided to be able to be drawn out from the storage chamber, the main container including:

an upper surface which is open; and a front surface having a hole;

a door that is tiltably connected to a lower position of the front surface of the main container by a hinge in order to selectively open and close the hole and draw out the main container from the storage chamber;

an auxiliary container that is received inside the main container and configured to move together with the main container based on movement of the door;

a latch protruding from a rear surface of the door;

a latch hole located at the front surface of the main container, the latch configured to be selectively received in or separated from the latch hole;

a pair of rails respectively installed on both side surfaces of the main container; and a pair of rail guides respectively installed on both side surfaces of the storage chamber and coupled with the pair of rails such that the main container is configured to slide into and out of the storage chamber, wherein, based on the door moving forward from the main body and tilting, the auxiliary container is drawn out together with the main container and is accessible by a user through the hole in the front surface of the main container and the upper surface of the main container, wherein the auxiliary container is separable from the main container through the upper surface of the main container, and wherein the auxiliary container is separable from the main container by being drawn out forward through the hole of the main container along a rear surface of the door in a state where the door is horizontally tilted to be separated from the main container.

2. The refrigerator according to claim 1, wherein an upper surface of the door is formed with a gripping groove.

3. The refrigerator according to claim 1, wherein a rear surface of the door is formed with at least one cup supporting groove.

4. The refrigerator according to claim 1, further comprising:

a handle part that is formed at a front surface or a bottom surface of the door, wherein the handle part is formed at a position near a rotational center of the door so that the door is vertically drawn out together with the main container.

5. The refrigerator according to claim 1, further comprising an auxiliary cooling chamber that is provided in an inner space of the main container and has a front surface portion exposed when the door is tilted.

6. The refrigerator according to claim 5, wherein the auxiliary cooling chamber includes a bottle chamber in which beverage bottles are received.

7. The refrigerator according to claim 5, wherein the auxiliary cooling chamber includes a quick cooling chamber for rapidly freezing beverage bottles.

8. The refrigerator according to claim 1, further comprising:

an elastic member or a hydraulic damper that is provided at a rotational shaft of the door.

9. The refrigerator according to claim 4, wherein the hinge is located at a lower end of the door, and wherein the latch and the latch hole are respectively located at an upper part of the door and the main container.

10. The refrigerator according to claim 9, wherein the handle part is located at a lower part of the door.

* * * * *